US009255335B2

(12) United States Patent
Kanan et al.

(10) Patent No.: US 9,255,335 B2
(45) Date of Patent: Feb. 9, 2016

(54) CATALYSTS FOR LOW TEMPERATURE ELECTROLYTIC CO2 REDUCTION

(75) Inventors: Matthew W. Kanan, Palo Alto, CA (US); Yihong Chen, Stanford, CA (US); Christina Li, Palo Alto, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 41 days.

(21) Appl. No.: 14/234,620

(22) PCT Filed: Jul. 25, 2012

(86) PCT No.: PCT/US2012/048179

§ 371 (c)(1), (2), (4) Date: Jun. 20, 2014

(87) PCT Pub. No.: WO2013/016447

PCT Pub. Date: Jan. 31, 2013

(65) Prior Publication Data

US 2014/0291163 A1 Oct. 2, 2014

Related U.S. Application Data

(60) Provisional application No. 61/511,824, filed on Jul. 26, 2011, provisional application No. 61/579,422, filed on Dec. 22, 2011.

(51) Int. Cl.

| | |
|---|---|
| ***C25B 3/04*** | (2006.01) |
| ***C25B 11/04*** | (2006.01) |
| ***C25B 1/00*** | (2006.01) |

(52) U.S. Cl.

CPC ..... *C25B 11/0478* (2013.01); *C25B 1/00* (2013.01); *C25B 3/04* (2013.01)

(58) Field of Classification Search

CPC ..... C25B 1/00; C25B 11/04; C25B 11/0478; C25B 3/04

USPC ..... 205/555; 204/277

See application file for complete search history.

(56) References Cited

U.S. PATENT DOCUMENTS 4,448,647 A * 5/1984 Gillich et al. ..... 205/50
4,609,441 A * 9/1986 Frese et al. ..... 205/450

(Continued)

FOREIGN PATENT DOCUMENTS

JP 07-188961 7/1995
JP 2004-026667 1/2004

(Continued)

OTHER PUBLICATIONS

Le et al. "Electrochemical Reduction of CO2 to CH3OH at Copper Oxide Surfaces" Journal of the Electrochemical Society, 158 (5) E45-E49 (2011).*

(Continued)

*Primary Examiner* — James Lin
*Assistant Examiner* — Leo Ahnn
(74) *Attorney, Agent, or Firm* — Beyer Law Group LLP

(57) ABSTRACT

A method for electrochemically reducing $CO_2$ is provided. A cathode is provided, wherein the cathode comprises a conductive substrate with a catalyst of a metal and a metal oxide based coating on a side of the cathode. An anode is spaced apart from the cathode. An ionic transport is provided between the anode and cathode. The cathode is exposed to $CO_2$ and $H_2O$. The anode is exposed to $H_2O$. A voltage is provided between the cathode and anode.

13 Claims, 11 Drawing Sheets

(56) References Cited

U.S. PATENT DOCUMENTS

| | | | |
|---|---|---|---|
| 5,064,733 | A | 11/1991 | Krist et al. |
| 7,566,388 | B2 | 7/2009 | Sasaki et al. |
| 2007/0054170 | A1 | 3/2007 | Isenberg |
| 2008/0283411 | A1 | 11/2008 | Eastman et al. |
| 2009/0016948 | A1 | 1/2009 | Young |

FOREIGN PATENT DOCUMENTS

| | | |
|---|---|---|
| JP | 2011-031238 | 2/2011 |
| WO | WO 2014/018091 | 1/2014 |

OTHER PUBLICATIONS

Frese "Electrochemical Reduction of C02 at Intentionally Oxidized Copper Electrodes", J. Electrochem. Soc., vol. 138, No. 11, Nov. 1991.*

Maniecki et al. "The Effect of Spinel Type Support FeAlO3, ZnAl2O4, CrAl3O6 on Physicochemical Properties of Cu, Ag, Au, Ru Supported Catalysts for Methanol Synthesis" Kinetics and Catalysis, 2009, vol. 50, No. 2, pp. 228-234.*

International Search Report dated Jun. 2, 2013 from International Application No. PCT/US2013025791.

Written Opinion dated Jun. 2, 2013 from International Application No. PCT/US2013025791.

Li et al., "$CO_2$ Reductionat Low Overpotential on Cu Electrodes Resulting from the Reduction of Thick $Cu_2O$ Films", Journal of the American Chemical Society, 134, 2012, pp. 7231-7234.

Chen et al., "Tin Oxide Dependence of the CO2 Reduction Efficiency on Tin Electrodes and Enhanced Activity for Tin/Tin Oxide Thin-Film Catalysts", Journal of the American Chemical Society, 134, 2012, pp. 1986-1989.

* cited by examiner

CATALYSTS FOR LOW TEMPERATURE ELECTROLYTIC CO2 REDUCTION

CROSS REFERENCE TO RELATED APPLICATIONS

This application claims priority under 35 U.S.C. §119 from U.S. Provisional Patent Application No. 61/511,824, filed Jul. 26, 2011, entitled CERIA-BASED ELECTROREDUCTION CATALYSTS FOR LOW-TEMPERATURE ELECTROLYTIC SYNGAS PRODUCTION and U.S. Provisional Patent Application No. 61/579,422, filed Dec. 22, 2011, entitled CATALYSTS FOR LOW TEMPERATURE ELECTROLYTIC CO2 REDUCTION, which are incorporated herein by reference for all purposes.

BACKGROUND OF THE INVENTION

This invention relates generally to the reduction of $CO_2$. Sustainable production of C-based fuel requires using renewable energy to power the reductive fixation of $CO_2$. Coupling renewable electricity to an electrolytic device is an attractive strategy for this goal because it enables the use of multiple renewable energy sources and independent optimization of catalysis. Solid oxide electrolytic cells reduce $CO_2$ to CO efficiently at high current densities, but require operating temperatures of 750-900° C. and cannot access other products.

Materials that catalyze electrochemical $CO_2$ reduction under mild conditions would enable the development of electrolyzers that operate at more convenient temperatures and provide access to alternative reduction products such as formic acid, alcohols and hydrocarbons. Researchers over the past three decades have identified several materials that are capable of reducing $CO_2$ electrochemically in aqueous solutions, but none that is efficient and stable enough for practical use. In general, available electrodes suffer from one or more of three major problems: 1) a requirement for excessive reducing potentials ("overpotentials") to reduce $CO_2$ in preference to reducing $H_2O$, resulting in low energetic efficiency; 2) rapid loss of $CO_2$ reduction activity resulting from electrode poisoning; 3) production of multiple $CO_2$ reduction products with little selectivity. There is a pressing need to discover and develop new electrochemical $CO_2$ reduction catalysts in order for sustainable fuels to be a significant contributor to a renewable energy economy.

SUMMARY OF THE INVENTION

In accordance with the invention, a method for electrochemically reducing $CO_2$ is provided. A cathode is provided, wherein the cathode comprises a conductive substrate with a catalyst of a metal and a metal oxide based coating on a side of the cathode. An anode is spaced apart from the cathode. An ionic transport is provided between the anode and cathode. The cathode is exposed to $CO_2$ and $H_2O$. The anode is exposed to $H_2O$. A voltage is provided between the cathode and anode.

In another manifestation of the invention, a method for electrochemically reducing $CO_2$ is provided. A coating is formed on a cathode by heating a metal layer of the cathode in air, electrochemically oxidizing the metal layer of the cathode, or by a metal oxide deposition to form a metal and metal oxide interface. An anode is spaced apart from the cathode. An ionic transport is provided between the anode and cathode. The coating is exposed to $CO_2$ and $H_2O$. The anode is exposed to $H_2O$. A voltage is provided between the cathode and anode.

In another manifestation of the invention an apparatus, for electrochemically reducing $CO_2$ is provided. An anode is provided. An oxidized cathode is spaced apart from the anode. A chamber for exposing the anode and oxidized cathode to at least one electrolyte is adjacent to the anode and oxidized cathode. A gas chamber for exposing the oxidized cathode to $CO_2$ is adjacent to the oxidized cathode. A $CO_2$ source for providing $CO_2$ to the gas chamber is connected to the gas chamber.

The invention and objects and features thereof will be more readily apparent from the following detailed description and appended claims when taken with the drawings.

DETAILED DESCRIPTION OF ILLUSTRATED EMBODIMENTS

Tin

Metal electrodes have been the focus of extensive $CO_2$ electroreduction studies in aqueous solutions at ambient temperature. Sn has attracted considerable interest because it is one of the most active metals and its low cost is amenable to large-scale use. Despite its appeal relative to other electrodes, the energy efficiency of Sn is too low for practical electrolysis. Sn is reported to require at least 0.86 V of overpotential to attain a $CO_2$ reduction partial current density of 4-5 mA/cm$^2$ in an aqueous solution saturated with 1 atm of $CO_2$. It is generally assumed that the bare Sn surface is the catalytically active surface for $CO_2$ reduction. The large overpotential required for $CO_2$ reduction is thought to result from the barrier associated with the initial $e^-$ transfer to form a $CO_2^{\bullet-}$ intermediate that is poorly stabilized by the Sn surface. This mechanistic scenario is commonly invoked for many metal electrodes.

In an embodiment of the invention, $SnO_x$ is essential to $CO_2$ reduction catalysis on Sn. This may be shown by demonstrating that removal of $SnO_x$ from a Sn electrode results in nearly exclusive $H_2$ evolution activity. This insight is subsequently applied to prepare a composite Sn/$SnO_x$ thin film catalyst that exhibits greatly enhanced $CO_2$ reduction activity relative to a typical Sn electrode.

Figure 1A:
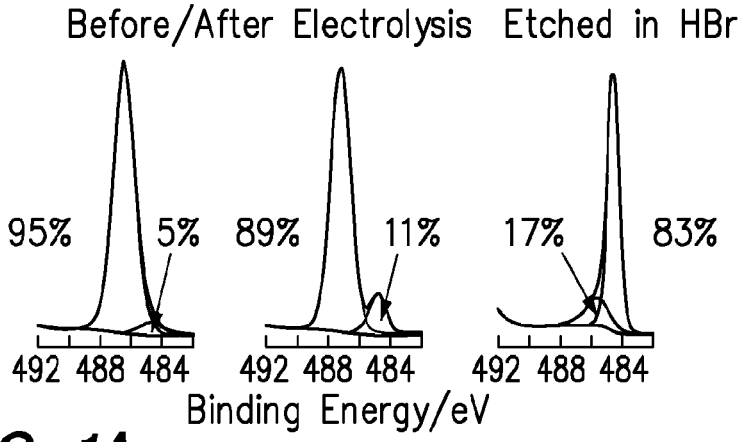
FIG. 1A shows the XPS spectra of untreated Sn foil before and after electrolysis and Sn foil after etching in HBr.
Figure 1B:
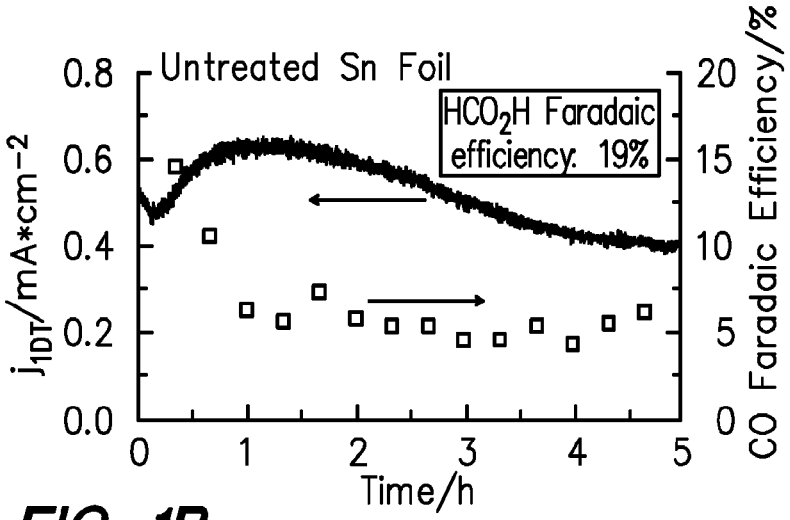
FIG. 1B is a plot of total current density vs time, CO faradaic efficiency vs time, and overall $HCO_2H$ faradaic efficiency at −0.7 V vs RHE in $CO_2$-saturated 0.5 M $NaHCO_3$ for unetched Sn.
Figure 1C:
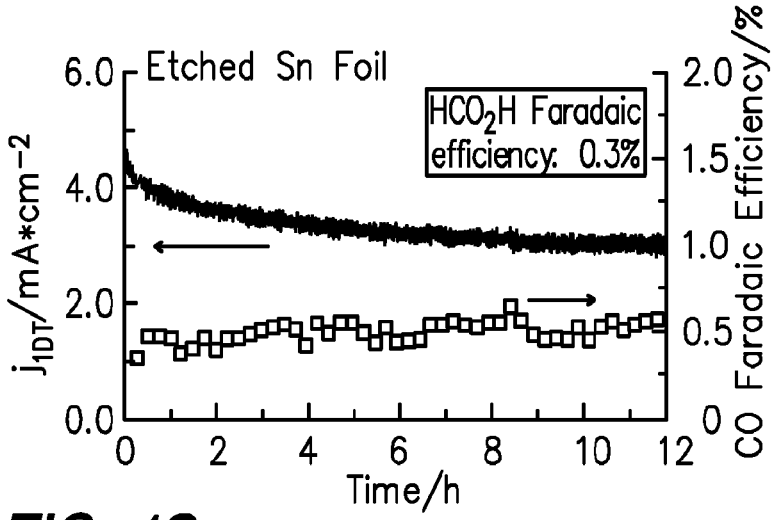
FIG. 1C is a plot of total current density vs time, CO faradaic efficiency vs time, and overall $HCO_2H$ faradaic efficiency for untreated Sn at −0.7 V vs RHE in $CO_2$-saturated 0.5 M $NaHCO_3$ for etched Sn.

To evaluate the importance of $SnO_x$ on the surface of Sn in $CO_2$ reduction, we compared the activity of Sn electrodes that had been etched in strong acid to the activity of untreated electrodes. In both cases, new pieces of high purity Sn foil (99.998%) were used. The surface of the untreated foil was examined by XPS to characterize the native SnOx layer. FIG. 1A shows the XPS spectra of untreated Sn foil before and after electrolysis (left) and Sn foil after etching in HBr (right). The curves are combinations of two Gaussian/Lorentzian curves at 486.5 eV and 484.7 eV. FIG. 1B is a plot of total current density vs time (indicated by the line), CO faradaic efficiency vs time (indicated by the ■ points) and overall $HCO_2H$ faradaic efficiency for untreated Sn at −0.7 V vs RHE in $CO_2$-saturated 0.5 M $NaHCO_3$ for unetched Sn. FIG. 1C is a plot of total current density vs time (indicated by the line), CO faradaic efficiency vs time (indicated by the ■ points) and overall $HCO_2H$ faradaic efficiency for untreated Sn at −0.7 V vs RHE in $CO_2$-saturated 0.5 M $NaHCO_3$ for etched Sn.

The high resolution Sn $3d_{5/2}$ spectrum was fit to two peaks at 486.5 eV and 484.7 eV that correspond to $Sn^{4+/2+}$ ($SnO_x$) and $Sn^0$, respectively. The ratio of corrected peak areas for $SnO_x$ to $Sn^0$ is 95:5, indicating the presence of a >5 nm native $SnO_x$ layer.

Etched electrodes were prepared by immersing the Sn foil in 24% HBr at 90° C. for 10 min. An XPS spectrum of the etched electrode taken immediately after removal from the HBr solution exhibited a $SnO_x$:$Sn^0$ ratio of 17:83 (FIG. 1A). The residual oxide observed on this electrode is likely due to oxide regrowth in the brief exposure to air upon transferring to the XPS chamber, as assessed by independent XPS experiments with a sputtered electrode. For electrolysis experiments, etched electrodes were rinsed with deionized water at the conclusion of the etching procedure and used immediately to minimize oxide regrowth.

The electrolyses were performed in an H-cell in 0.5 M aqueous $NaHCO_3$ saturated with $CO_2$ ("$NaHCO_3/CO_2$") at a potential of −0.7 V vs the reversible hydrogen electrode (RHE; all potentials are referenced to this electrode). The headspace of the cathodic compartment was continuously purged with $CO_2$ into the sampling valve of a gas chromatograph (GC), enabling periodic quantification of the gas phase products. FIG. 1B shows the total geometric current density ($j_{tot}$) vs time and the faradaic efficiency for CO production at various time points for an untreated Sn electrode. The electrode exhibits a current density of 0.4-0.6 mA/cm$^2$ and a steady-state faradaic efficiency for CO of 5-10%. NMR analysis of the electrolyte at the conclusion of the experiment indicates 19% faradaic efficiency for $HCO_2H$; the remainder of the current is accounted for by $H_2$ formation. This $CO_2$ reduction activity is consistent with the best reported activity for Sn at −1.06 V, taking into account the difference in overpotential. An electrode examined by XPS after a 12 h electrolysis at −0.7 V exhibited a $SnO_x$:$Sn^0$ ratio of 89:11, indicating that the native $SnO_x$ layer is stable to the reduction conditions (FIG. 1A).

Strikingly, an etched Sn electrode exhibits a much higher $j_{tot}$ of 3-4 mA/cm$^2$, but very low faradaic efficiency for CO (0.5%) and $HCO_2H$ production (0.3%) (FIG. 1C). The higher $j_{tot}$ likely reflects a larger electrochemical surface area due to etching. Despite the higher surface area, the geometric partial current density for $CO_2$ reduction is lower for the etched Sn electrode (24-32 μA/cm$^2$) than the untreated Sn electrode (92-140 μA/cm$^2$) due to the much lower faradaic efficiency. Very low (<1%) $CO_2$ reduction faradaic efficiencies on etched Sn are also observed over a range of potentials from −0.5 V to −1.0 V. Thus, etched Sn is a moderately efficient $H_2$ evolution catalyst, but is essentially inactive for $CO_2$ electroreduction. Similar results were obtained if Sn electrodes were etched by polarizing at −3 V in HCl solution instead of treating with hot HBr solution.

Together, the XPS and electrolysis results indicate that removal of the native $SnO_x$ layer from a Sn electrode suppresses $CO_2$ reduction activity such that $H_2$ evolution accounts for >99% of the current density. The small residual $CO_2$ reduction activity observed on etched Sn likely reflects the growth of a small amount of $SnO_x$ on the etched electrode before the start of electrolysis.

Based on these results, we hypothesized that the simultaneous deposition of $Sn^0$ and $SnO_x$ on an electrode surface would result in a material with enhanced Sn—$SnO_x$ contact that is consequently a more active catalyst for $CO_2$ reduction than a typical Sn foil electrode with a native $SnO_x$ layer. Accordingly, we sought electrodeposition conditions in which the hydrolysis of $Sn^{2+}$ by cathodically generated $OH^-$ would take place concurrently with the reduction of $Sn^{2+}$ to $Sn^0$ ($E^0$=−0.1375 V vs NHE). As described below, deposition on Ti electrodes under the same conditions used for $CO_2$ electroreduction proved to be particularly effective.

Figure 2A:
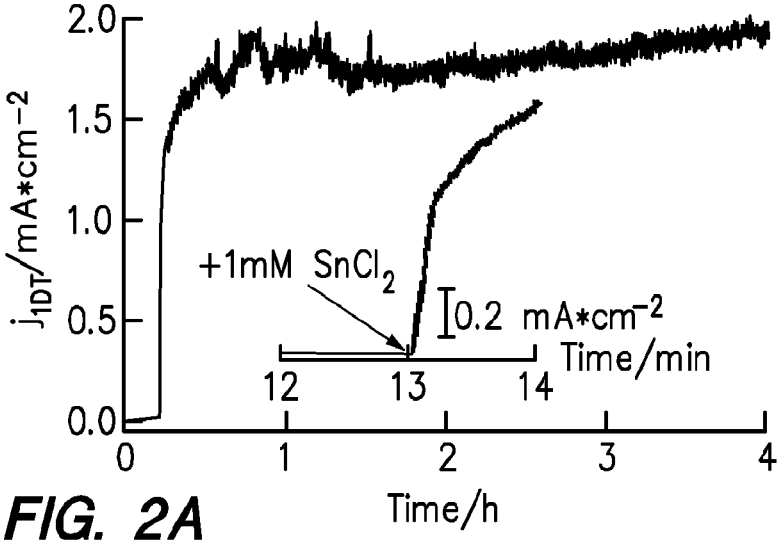
FIG. 2A depicts the bulk electrolysis trace at −0.7 V in $NaHCO_3/CO_2$ electrolyte for a Ti cathode before and after the addition of 1 mM $SnCl_2$ to the electrolyte.

FIG. 2A depicts the bulk electrolysis trace at −0.7 V in $NaHCO_3/CO_2$ electrolyte for a Ti cathode before and after the addition of 1 mM $SnCl_2$ to the electrolyte. Prior to the addition of $Sn^{2+}$, the Ti electrode exhibits a current density of ~10 μA/cm$^2$ with very little detectable $CO_2$ reduction. Addition of $Sn^{2+}$ results in a sharp rise in the current density to a steady-state value of ~1.8 mA/cm$^2$ and the formation of a grey deposit on the electrode surface. The current density is stable for >10 h and corresponds to >85% $CO_2$ reduction with the remainder accounted for by $H_2$ evolution. Nearly identical results are obtained if $Sn(OTf)_2$ is used instead of $SnCl_2$, indicating that $Cl^+$ is not necessary for catalyst formation.

Figure 2B:
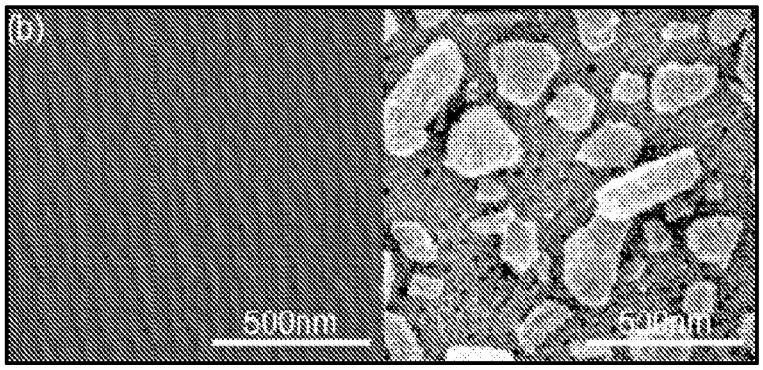
FIG. 2B shows SEM images of a Ti electrode before and after deposition showing the formation of a porous, particulate film with ~100 nm-diameter pieces atop a more uniform layer.
Figure 2C:
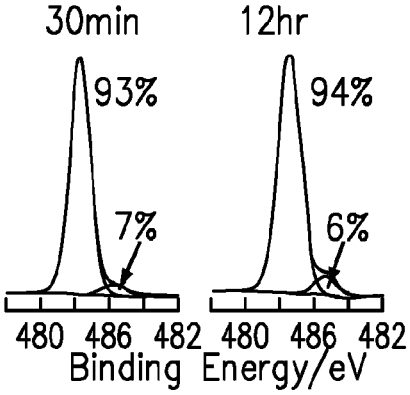
FIG. 2C is a high resolution Sn $3d_{5/2}$ XPS of a $Sn/SnO_x$ catalyst removed 30 mM or 12 h after the addition of $Sn^{2+}$.
Figure 2D:
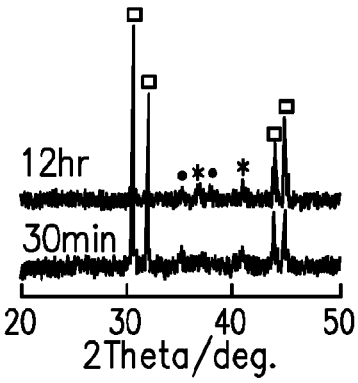
FIG. 2D provides graphs of XRD patterns showing $Sn^0$, $SnO_2$, and Ti peaks after 30 min or 12 h.

The composition and structure of the electrodeposited catalyst were characterized by a combination of scanning electron microscopy (SEM), XPS and powder x-ray diffraction (XRD). A catalyst was prepared via in situ deposition as described above and removed from the electrolyte 30 min after the addition of $Sn^{2+}$. FIG. 2B shows SEM images of a Ti electrode before (left) and after (right) deposition showing the formation of a porous, particulate film with ~100 nm-diameter pieces atop a more uniform layer. FIG. 2C is a high resolution Sn $3d_{5/2}$ XPS of a $Sn/SnO_x$ catalyst removed 30 min (left) or 12 h (right) after the addition of $Sn^{2+}$. XPS analysis indicates a $SnO_x$:$Sn^0$ ratio of 93:7, similar to the ratio observed for Sn foil electrodes with a native $SnO_x$ layer. FIG. 2D provides graphs of XRD patterns showing $Sn^0$ (■), $SnO_2$ (★) and Ti (●) peaks after 30 min or 12 h. In the XRD pattern of this electrode, strong $Sn^0$ peaks are observed along with small peaks that correspond to $SnO_2$. The latter are absent for a Sn foil electrode with a native $SnO_x$. For comparison, a separate catalyst film was prepared and removed for analysis 12 h after the addition of $Sn^{2+}$. The XPS spectrum, shown in FIG. 2C, and XRD pattern for this electrode are very similar to those of the sample removed after 30 min. Together, these results indicate that a composite $Sn/SnO_x$ material is formed under the deposition conditions.

Figure 3A:
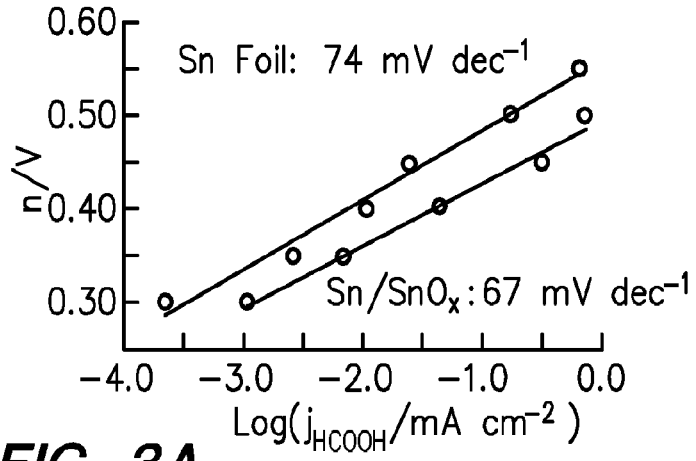
FIGS. 3A-C shows the comparison of $CO_2$ reduction catalysis for unexcited Sn foil and in situ deposited $Sn/SnO_x$ thin film electrodes.
Figure 3B:
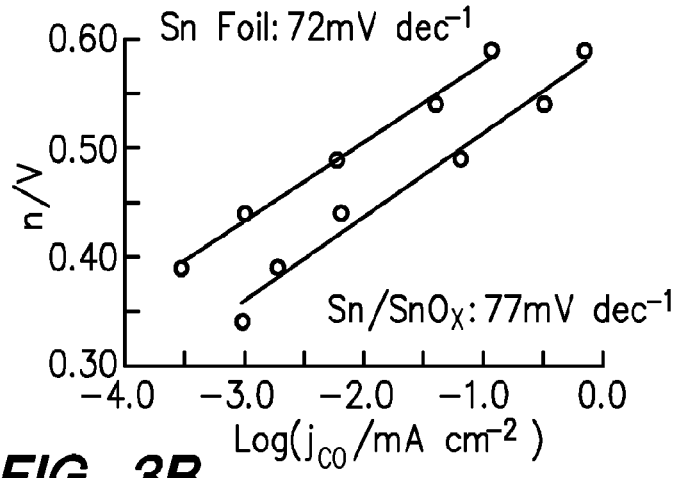
Figure 3C:
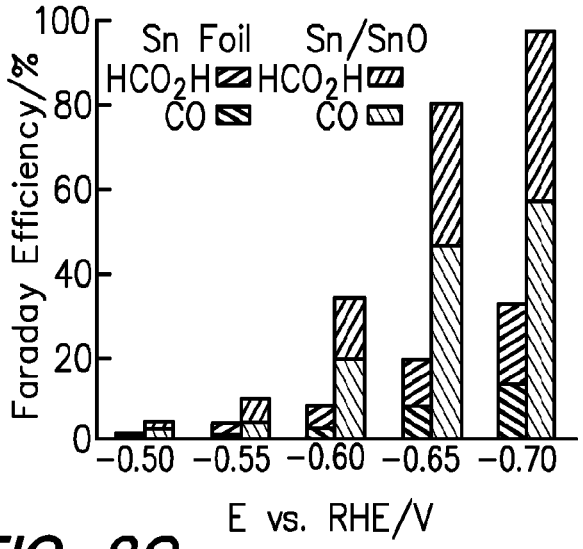

The electrodeposited catalyst (hereafter referred to as "$Sn/SnO_x$") exhibits greatly enhanced $CO_2$ reduction catalysis compared to a typical Sn foil electrode with a native $SnO_x$ layer. For both electrodes, CO, $HCO_2H$ and $H_2$ together account for >99% of the reduction products in $NaHCO_3/CO_2$ electrolyte. To compare the activities of Sn foil and $Sn/SnO_x$, we measured their partial current densities for CO and $HCO_2H$ at selected potentials between −0.5 and −0.7 V. Comparison of $CO_2$ reduction catalysis for Sn foil and in situ deposited Sn/SnO, thin film electrodes are illustrated in FIGS. 3A-C. FIG. 3A shows Tafel plots for $HCO_2H$ production. FIG. 3B shows Tafel plots for CO production. FIG. 3C is a bar graph showing Faradaic efficiencies for $HCO_2H$ and CO at various potentials. These data were obtained by performing stepped-potential electrolyses with periodic quantification of the gaseous products by GC and removal of aliquots after each step for NMR analysis.

For Sn foil, approximate Tafel slopes of 74 mV/dec and 72 mV/dec are observed for $HCO_2H$ and CO production, respectively. Similar Tafel slopes are observed for $HCO_2H$ (67 mV/dec) and CO (77 mV/dec) production on $Sn/SnO_x$, however the geometric partial current densities are 7-8-fold higher than for Sn foil. The higher geometric current densities on Sn/SnOx are not simply the result of greater electroactive surface area, as indicated by cyclic voltammetry and the dramatic differences in faradaic efficiencies for Sn foil and $Sn/SnO_x$. Over the range of potentials used for Tafel analysis, the CO faradaic efficiencies are 4-fold higher and the $HCO_2H$ faradaic efficiencies are 2-3-fold higher on $Sn/SnO_x$ than on untreated Sn foil.

The Tafel slopes for $HCO_2H$ and CO production on both Sn foil and $Sn/SnO_x$ are inconsistent with $CO_2$ reduction mechanisms that proceed through an initial rate-determining 1 $e^-$ transfer to $CO_2$. Such a mechanism would result in a 118 mV/dec slope. The observed slopes are instead much closer to 59 mV/dec, which supports mechanisms in which there is a reversible 1 $e^-$ transfer to $CO_2$ to form $CO_2^{\bullet-}$ prior to a chemical rate-determining step. Possibilities for the chemical rate-determining step include protonation of $CO_2^{\bullet-}$ or migration to an alternative site on the electrode surface. Competing rate-determining steps, such as protonation at C vs O of $CO_2^{\bullet-}$, may determine the $HCO_2H$ vs CO selectivity.

The Tafel data, combined with the absence of appreciable $CO_2$ reduction activity on etched Sn, suggest that $SnO_x$ enables $CO_2$ reduction to occur by stabilizing $CO_2^{\bullet-}$. At present, we cannot determine whether reduction takes place at the interface between $Sn^0$ and $SnO_x$ or on the $SnO_x$ surface directly. In the absence of $SnO_x$ to stabilize $CO_2^{\bullet-}$, $Sn^0$ only catalyzes $H_2$ evolution because the 1 $e^-$ transfer to $CO_2$ is prohibitively slow. The higher $CO_2$ reduction partial current density and faradaic efficiency on $Sn/SnO_x$ relative to Sn foil with a native $SnO_x$ layer are therefore indicative of a greater density of active sites for $CO_2$ reduction and a higher ratio of these sites to $H_2$ evolution sites for the in situ deposited catalyst.

The $CO_2$ reduction activity of $Sn/SnO_x$, as indicated by the Tafel plots and faradaic efficiencies in FIGS. 3A-C, compares favorably to all polycrystalline metal electrodes in aqueous electrolytes with the exception of Au, which is comparably active initially, but subject to rapid deactivation. Improving $CO_2$ and ion mass transport by incorporating Sn/SnOx in a flow cell and/or a gas diffusion electrode may enable increasing the current density by 1-2 orders of magnitude without large overpotential increases. Elucidating the detailed mechanistic role of $SnO_x$ in mediating electron transfer to $CO_2$ is an important objective toward this goal. Moreover, the importance of $SnO_x$ to $CO_2$ reduction on Sn surfaces raises the possibilities that metal oxides may be involved in $CO_2$ reduction pathways on other metal electrodes and that the preparation of alternative metal/metal oxide composites may yield additional $CO_2$ reduction catalysts with superior activity.

Copper

Polycrystalline Cu has been the focus of most $CO_2$ reduction studies because it is one of the best available catalysts and is capable of producing hydrocarbon products. Although mechanistic studies have yielded valuable insights into the $CO_2$ reduction pathways on Cu, the principal shortcomings of this electrode have not been addressed. Most significantly, the energetic efficiency of Cu is limited by the large overpotential (>0.7 V) required for $CO_2$ reduction to outcompete $H_2O$ reduction. In addition, Cu electrodes rapidly lose their $CO_2$ reduction activity unless stringently purified electrolytes are used, a requirement that is not compatible with scalable fuel synthesis.

Achieving efficient Cu-catalyzed $CO_2$ reduction requires preparing Cu particles whose surfaces have active sites that are different from those on the surface of a polycrystalline Cu electrode. Electrochemical reduction of metal oxides provides one possible route to metal particles with altered surface structures. Researchers have previously used electrochemical methods including potential cycling and anodic pulses to form and subsequently reduce oxides on Cu electrodes. These treatments have resulted in increased hydrogen evolution activity in alkaline electrolytes and altered product selectivity at high overpotential in $CO_2$ reduction electrolyses. While these studies provide evidence of altered electrocatalytic properties, substantial improvements to the energetic efficiency of $CO_2$ reduction have not been observed. Researchers have also used copper oxide electrodes in $CO_2$ reduction electrolyses. The oxides were reduced to $Cu^0$ in situ during $CO_2$ reduction catalysis, but only transient changes in the $CO_2$ product distribution attributed to oxide catalysis were observed. Here we show that the $CO_2$ reduction properties of $Cu^0$ electrodes resulting from copper oxide reduction vary widely depending on the properties of the initial oxide layer. Reduction of thick $Cu_2O$ layers formed by high temperature annealing results in electrodes that catalyze energy-efficient $CO_2$ reduction and are stable to the deactivation phenomena that plague bulk metal electrodes.

Electrodes were prepared by electropolishing pieces of polycrystalline Cu foil (99.9999%) in 85% phosphoric acid and subsequently annealing the electrodes in air at selected temperatures for variable amounts of time. The activities of these electrodes were compared to that of a polycrystalline Cu electrode in controlled potential electrolyses performed in $CO_2$-saturated 0.5 M $NaHCO_3$ electrolyte ("$NaHCO_3/CO_2$") in a two-compartment electrolysis cell. The headspace of the cathodic chamber was continuously purged with $CO_2$ into the sampling loop of a gas chromatograph (GC) to enable periodic quantification of the gas-phase products. The solution-phase products were quantified by NMR analysis of the electrolyte at the conclusion of the electrolyses.

FIGS. 4A-E shows the total geometric current density ($j_{tot}$) vs time, the faradaic efficiency (FE) for CO vs time and the overall FE for $HCO_2H$ for the polycrystalline Cu electrode (FIG. 4A) and several of the annealed electrodes (FIG. 4B-E) with progressively thicker initial $Cu_2O$ layers at 0.5 V vs the reversible hydrogen electrode (RHE; all potentials are referenced to this electrode). The polycrystalline Cu electrode exhibited a $j_{tot}$ of ~100 μA/cm$^2$, a FE for CO that declined from 10% at the start of the electrolysis to <2% over the course of 7 h and a FE for $HCO_2H$ of 3%. The majority of the current, >90%, was due to $H_2$ evolution. These values are consistent with the previously measured activity for Cu in $KHCO_3$ electrolytes. Annealing Cu at 130° C., the temperature used to prepare $Cu_2O$ electrodes for most previous studies, had very little effect on the activity under these conditions. The electrode annealed at 130° C. for 12 h (FIG. 4B) exhibited a $j_{tot}$ of 10 mA/cm$^2$ during the first 4 s in which the thin $Cu_2O$ layer was reduced. Subsequently, the $j_{tot}$ and FEs were very similar to those of the polycrystalline electrode.

Figure 4A:
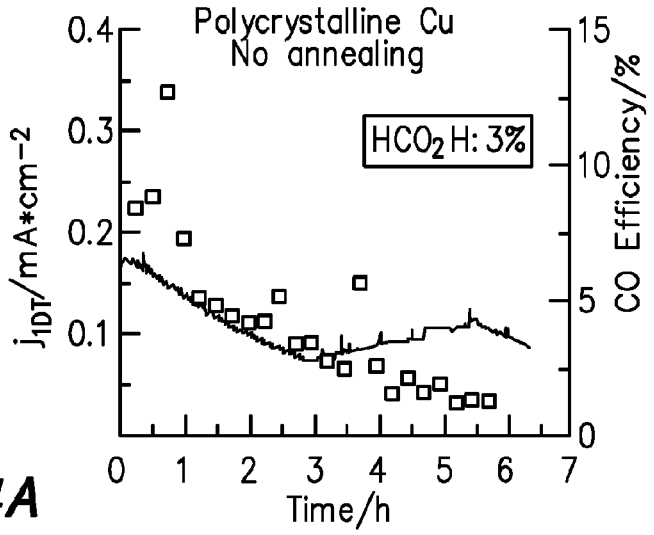
FIGS. 4A-E shows the total geometric current density ($j_{tot}$) vs time, the faradaic efficiency (FE) for CO vs time and the overall FE for $HCO_2H$ for the polycrystalline Cu electrode and several of the annealed electrodes with progressively thicker initial $Cu_2O$ layers at −0.5 V vs the reversible hydrogen electrode.
Figure 4B:
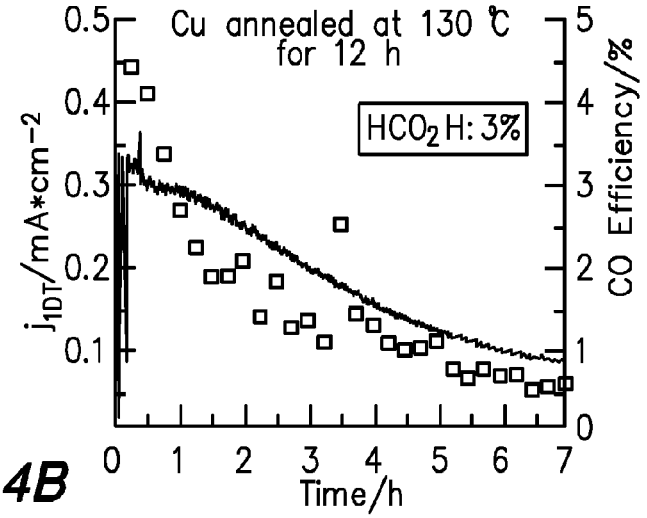
Figure 4C:
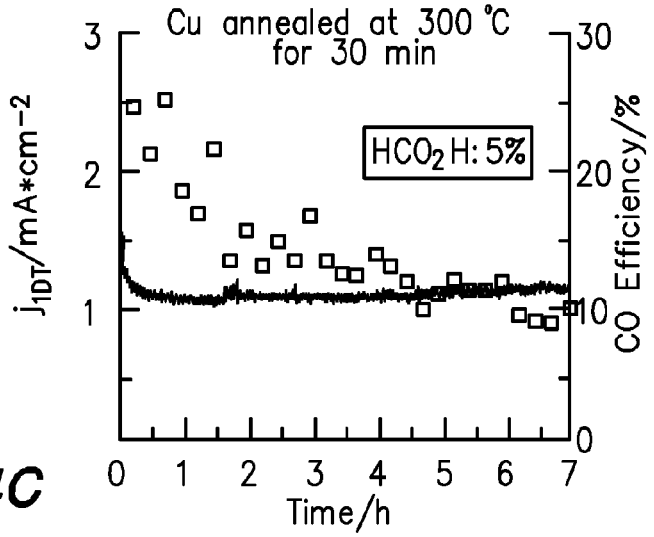
Figure 4D:
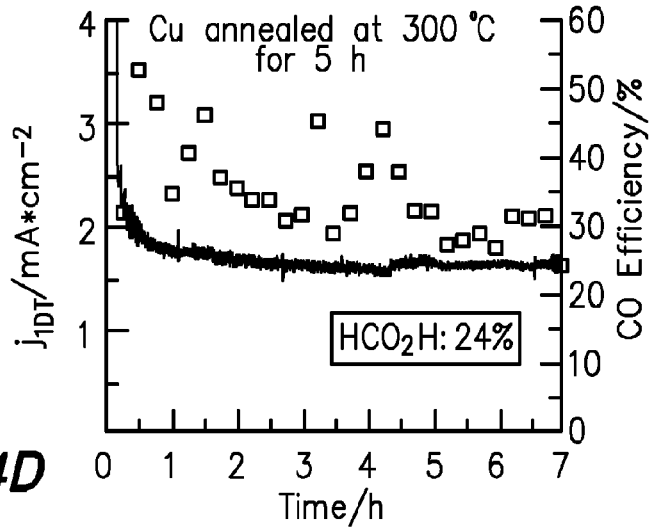
Figure 4E:
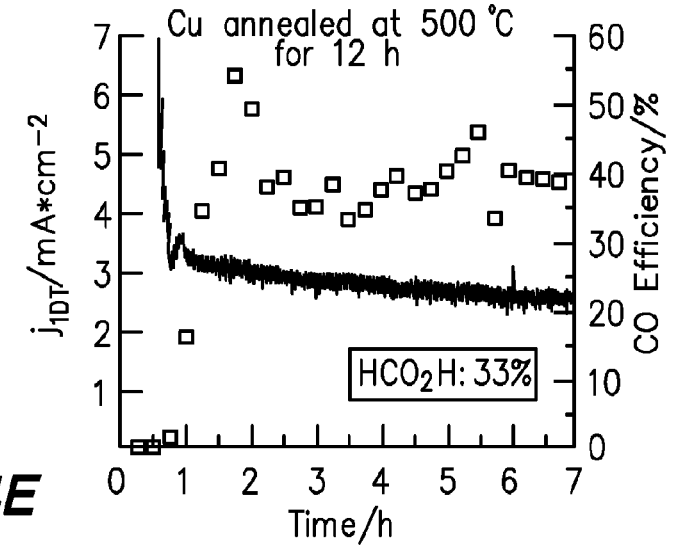

In contrast to these results, the electrodes annealed at higher temperatures exhibited larger $j_{tot}$ values and improved $CO_2$ reduction FEs upon reduction of the $Cu_2O$ layer. The electrode annealed at 300° C. for 30 min exhibited an initial $j_{tot}$ of 10 mA/cm$^2$ for 2 min as the $Cu_2O$ was reduced and subsequently a stable $j_{tot}$ of 1.0 mA/cm$^2$. The FE for CO was 25% during the first hour of electrolysis before declining to 10% over 7 h; the FE for $HCO_2H$ on the reduced electrode was 5%. Further improvements were obtained by starting with a thicker $Cu_2O$ layer. After $Cu_2O$ reduction of the electrode annealed at 300° C. for 5 h, $j_{tot}$ reached a stable value of 1.3 mA/cm$^2$, the FE for CO reached 35% and the FE for $HCO_2H$ was 24% (FIG. 4D). Annealing at 500° C. for 12 h resulted in an even thicker $Cu_2O$ layer and a stable $j_{tot}$ of 2.7 mA/cm$^2$. This electrode produced CO with 40% FE and $HCO_2H$ with 33% FE. Notably, the FE for CO was maintained at 40% throughout the electrolysis, indicating not only efficient but also stable activity for $CO_2$ reduction on this surface.

Figure 4F:
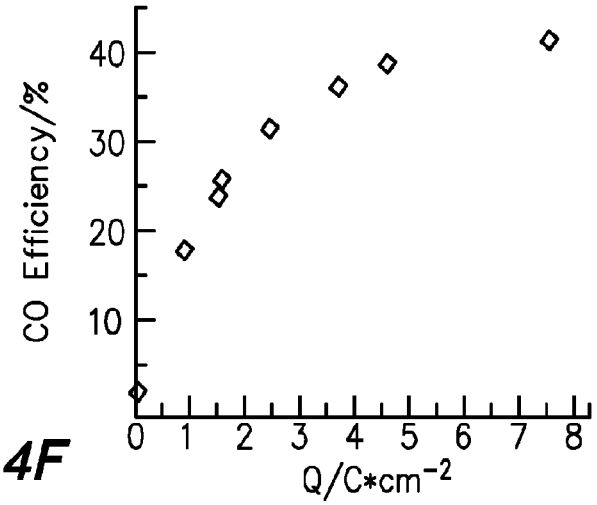
FIG. 4F shows the average FE for CO vs the amount of charge required to reduce the $Cu_2O$ layer per electrode area.
Figure 5A:
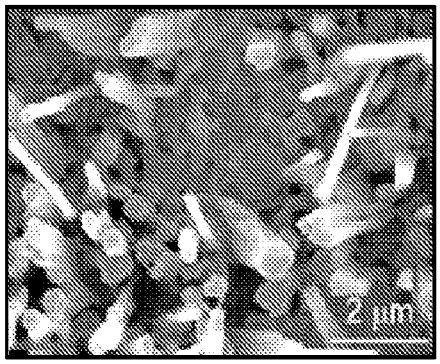
FIGS. 5A-F show the scanning electron microscopy (SEM) images, X-ray diffraction (XRD) patterns, and high-resolution Cu 2p X-ray photoelectron spectroscopy (XPS) spectra for a Cu electrode after annealing procedure and after subsequent $CO_2$ reduction electrolysis.
Figure 5D:
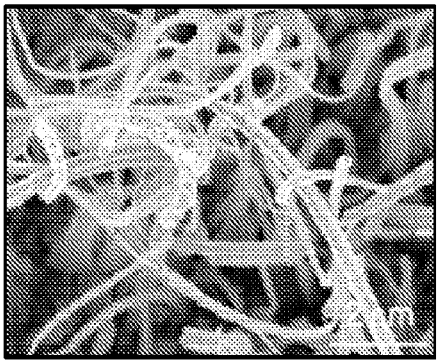
Figure 5B:
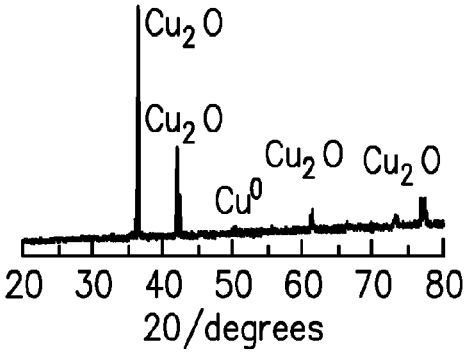
Figure 5E:
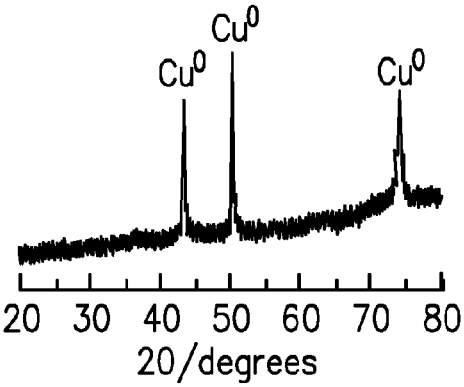
Figure 5C:
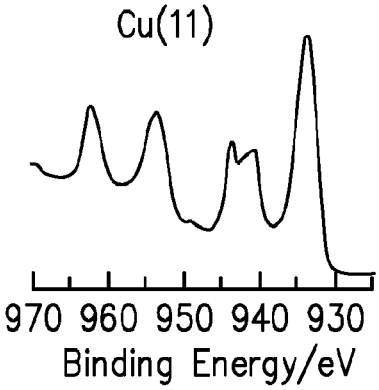
Figure 5F:
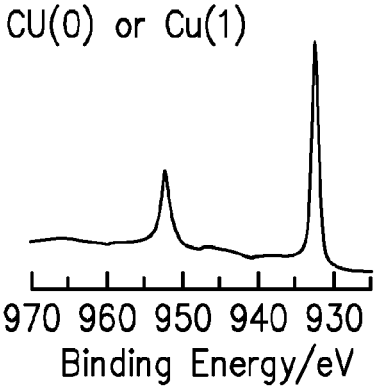

A plot of the average CO FEs for the annealed electrodes vs the amount of charge passed per electrode area (Q) in the $Cu_2O$ reduction is shown in FIG. 4F. The FEs increased with the amount of charge passed until reaching a plateau at 30-40% for Q≥~5 C/cm$^2$. Assuming bulk density of $Cu_2O$ on the electrode, 5 C/cm$^2$ corresponds to a ~3 μm-thick layer. Together, these results demonstrate that a threshold thickness of the initial $Cu_2O$ layer is required to achieve both efficient and stable $CO_2$ reduction catalysis for the electrode resulting from $Cu_2O$ reduction. Based on these results, electrodes prepared by annealing Cu at 500° C. for 12 h were selected for further characterization and $CO_2$ reduction studies. FIGS. 5A-F show the scanning electron microscopy (SEM) images (FIGS. 5A,D), X-ray diffraction (XRD) patterns (FIGS. 5B,E), and high-resolution Cu 2p X-ray photoelectron spectroscopy (XPS) spectra (FIGS. 5C,F) for a Cu electrode after this annealing procedure (FIGS. 5A-C) and after subsequent $CO_2$ reduction electrolysis (FIGS. 5D-F). After annealing, the SEM showed a dense array of rods with 100-1000 nm diameters on the electrode surface. These rods are the outermost portion of a thick $Cu_2O$ layer coating the electrode, as evidenced by the large $Cu_2O$ peaks and the near complete suppression of the Cu° peaks in the XRD pattern. The characteristic $Cu^{2+}$ satellite peaks in the XPS spectrum are consistent with the presence of a thin (<10 nm) CuO layer coating the $Cu_2O$. Following $CO_2$ reduction electrolysis, SEM indicated that the rod morphology was intact, but smaller particles (~20 nm) were embedded within the rods (FIG. 5D and FIG. S3). Only $Cu^0$ peaks were observed in the XRD pattern, FIG. 5F. The Cu 2p XPS spectrum indicated the presence of $Cu^0$ or $Cu^{1+}$, but the peaks associated with $Cu^{2+}$ in the spectra prior to electrolysis were absent. Together, these results indicate the complete reduction of the $Cu_2O$ layer, although we cannot rule out the presence of a thin, metastable $Cu_2O$ layer or other surface-bound $Cu^{1+}$ species during electrocatalysis.

The electrochemically active surface area of a reduced electrode that had been annealed at 500° C. for 12 h was determined by measuring the double layer capacitance in 0.1 M $HClO_4$ after $CO_2$ reduction electrolysis. The capacitance was 13.9 mF/cm$^2$, which is 475× larger than the capacitance of 29 μF/cm$^2$ measured for a polycrystalline Cu electrode. This roughness factor is considerably larger than the difference in $j_{tot}$ between the two electrodes (~30×), consistent with the difference in FEs between the two electrodes.

The presence of 100-1000 nm rods observed in FIG. 5D is not necessary for efficient $CO_2$ reduction. Electrodes annealed at temperatures ≥500° C. for variable amounts of time exhibited very different morphological features on this length scale, but nonetheless comparable FEs for $CO_2$ reduction at −0.5 V. These results suggest that the $CO_2$ reduction efficiency of electrodes annealed at high temperatures is associated with a Cu particle surface or grain boundary structure that forms when suitably thick $Cu_2O$ layers are electrochemically reduced.

Figure 6A:
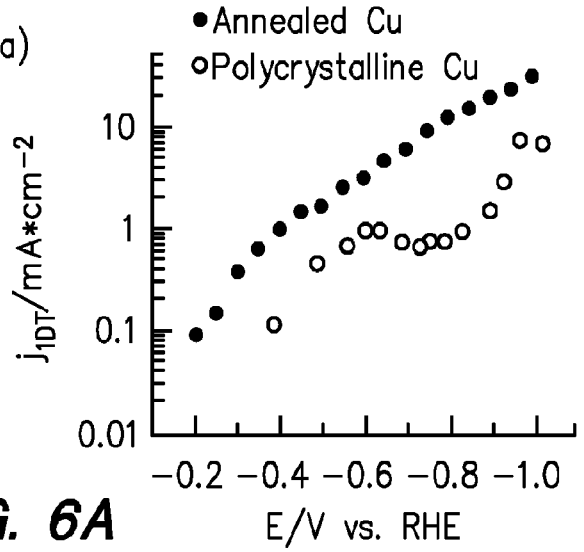
FIGS. 6A-C show the total current densities and faradaic efficiencies for the major products for a Cu electrode annealed at 500° C. for 12 h and for polycrystalline Cu.
Figure 6B:
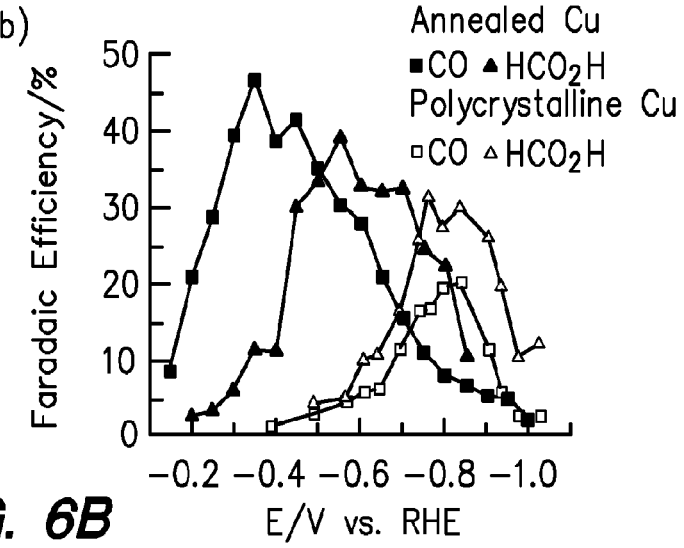
Figure 6C:
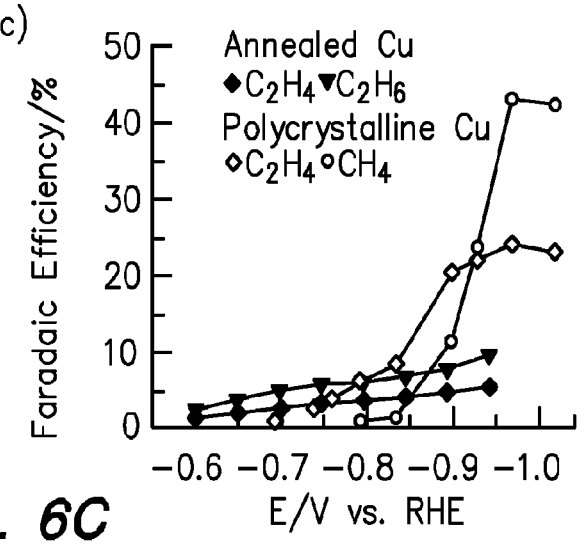

To further characterize the effect of high temperature annealing on the $CO_2$ reduction activity of Cu, we measured the partial current densities for the reduction products at a variety of potentials between −0.2 V and −1.0 V in $NaHCO_3/CO_2$ using an electrode that had been annealed at 500° C. for 12 h (hereafter referred to as "annealed Cu"). The total current densities and faradaic efficiencies for the major products are shown in FIGS. 6A-C, which provides comparisons of electrocatalytic activities of polycrystalline Cu and Cu annealed at 500° C. for 12 h. FIG. 6A is a graph of total current density vs. potential. FIG. 6B is a graph of faradaic efficiencies for CO and $HCO_2H$ vs potential. FIG. 6C is a graph of faradaic efficiencies for $CH_4$, $C_2H_4$ and $C_2H_6$ vs potential. Attempts to collect the corresponding data under identical conditions with polycrystalline Cu were unsuccessful due to the rapid degradation of catalytic activity. Instead, optimal data from previous studies with polycrystalline Cu at several potentials in 0.1 M $KHCO_3$ are included for comparison.

The annealed Cu electrode exhibits a high efficiency for $CO_2$ reduction at remarkably low overpotentials. A peak faradaic efficiency of 45% for CO production is obtained at potentials ranging from 0.3 V to 0.5 V, corresponding to 0.19 V to 0.39 V of overpotential for this product (FIG. 6B). By comparison, essentially no $CO_2$ reduction to CO is observed for polycrystalline Cu in this potential range; the maximum efficiency for CO with polycrystalline Cu is 20%, which requires 0.8 V (η=0.69 V). Similarly, annealed Cu attains a peak faradaic efficiency for $HCO_2H$ production of 30% at potentials ranging from 0.45 V to 0.65 V (η=0.25 V to 0.45 V), whereas polycrystalline Cu requires −0.7 V to −0.9 V (η=0.5 V to 0.7 V) to attain a comparable faradaic efficiency (FIG. 6B).

At relatively negative potentials (<−0.6 V), annealed Cu catalyzes the reduction of $CO_2$ to ethylene and ethane (FIG.

6C). In contrast, polycrystalline Cu produces only ethylene and methane at high overpotential. Previous work on Cu single crystals has shown that the ratio of ethylene to methane can be boosted by introducing (111) steps in the (100) basal plane, i.e. by using single crystal Cu electrodes with a high index face exposed to the solution. However, methane was never fully suppressed and no ethane was observed in these studies. These results indicate that the surface structures of the Cu particles produced by $Cu_2O$ reduction are distinct from the structures of the high index faces of Cu. We also note that no methanol was detected among the reduction products for annealed Cu at any potential examined here, in contrast to what has been reported for $CO_2$ reduction catalysis with Cu electrodes annealed at lower temperatures.

The faradaic efficiencies for the hydrocarbon products on annealed Cu are low and $H_2$ is the major product at high overpotentials. This difference relative to the lower overpotential regime most likely reflects the mass transport limitations at the high current densities observed (>10 mA/cm$^2$) rather than the intrinsic selectivity of the electrode Improvements in mass transport by using a flow cell or gas diffusion electrode are expected to enable substantially higher $CO_2$ reduction current densities without large overpotential increases.

Figure 7:
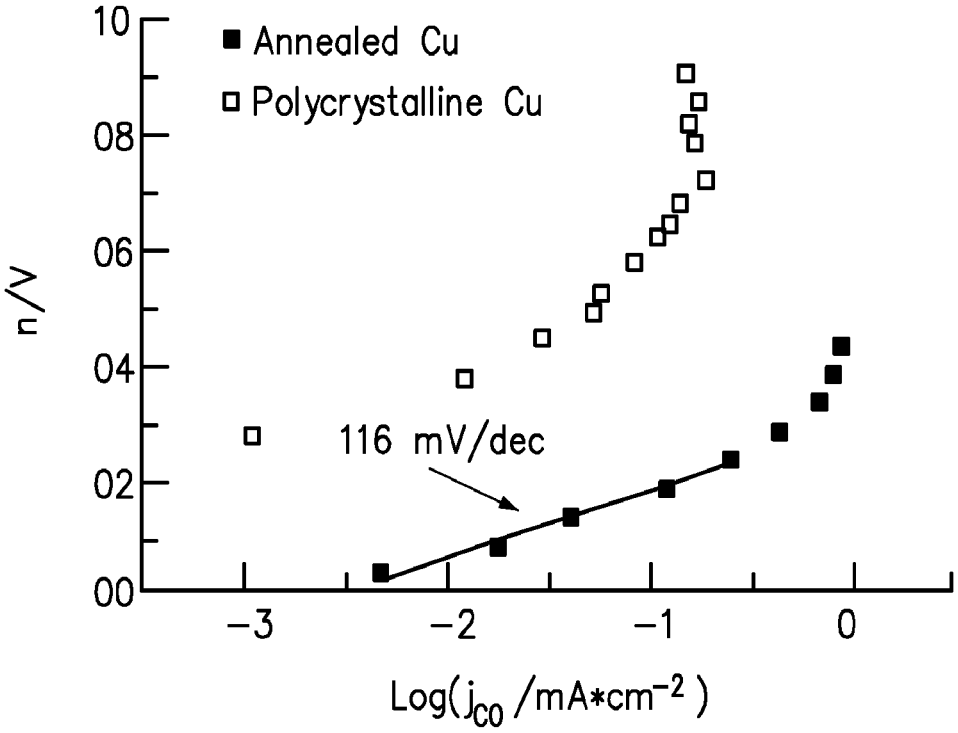
FIG. 7 shows Tafel data for a Cu electrode annealed at 500° C. for 12 h and Tafel data for polycrystalline Cu.

To obtain insight into the mechanistic pathway(s) for $CO_2$ reduction with annealed Cu, a plot of overpotential vs the log of the partial current density for CO production (a Tafel plot) was extracted from the data described above. The data are shown in FIG. 7 along with Tafel data for polycrystalline Cu. The plot for annealed Cu is linear over the range of overpotentials from 0.05 V to 0.3 V with a slope of 116 mV/decade. This slope is consistent with a rate-determining initial electron transfer to $CO_2$ to form a surface-adsorbed $CO_2^{\bullet-}$ intermediate, a mechanism that is commonly invoked for metal electrodes. A similar slope is evident in the plot for polycrystalline Cu. The dramatic difference in FE between the two electrodes suggests that the Cu surfaces formed by reducing thick $Cu_2O$ layers enable formation of the $CO_2^{\bullet}$ intermediate while suppressing $H_2O$ reduction.

In summary, our results show that Cu particles prepared by reducing μm-thick $Cu_2O$ films catalyze the reduction of $CO_2$ to CO and $HCO_2H$ with high faradaic efficiencies at exceptionally low overpotentials and produce C2 hydrocarbons to the exclusion of $CH_4$ at high overpotentials. Electrodes with these characteristics can readily be prepared with high surface areas, enabling >1 mA/cm$^2$ geometric current densities for $CO_2$ reduction at <0.4 V overpotential and measurable $CO_2$ reduction current densities at <0.1 V overpotential, levels of activity that were previously inaccessible with metal electrodes under comparable conditions. Furthermore, $CO_2$ reduction with these electrodes is resistant to deactivation for at least several hours, a marked improvement over the rapid deactivation of polycrystalline Cu under identical conditions. We anticipate that elucidation of the surface structures of the Cu particles formed by reducing thick $Cu_2O$ layers will provide crucial insights into the structural requirements for preferential $CO_2$ reduction and the formation of C2 products. In addition, this synthetic approach may prove useful for preparing additional electrocatalysts for $CO_2$ reduction.

Embodiments of Implementation

Figure 8:
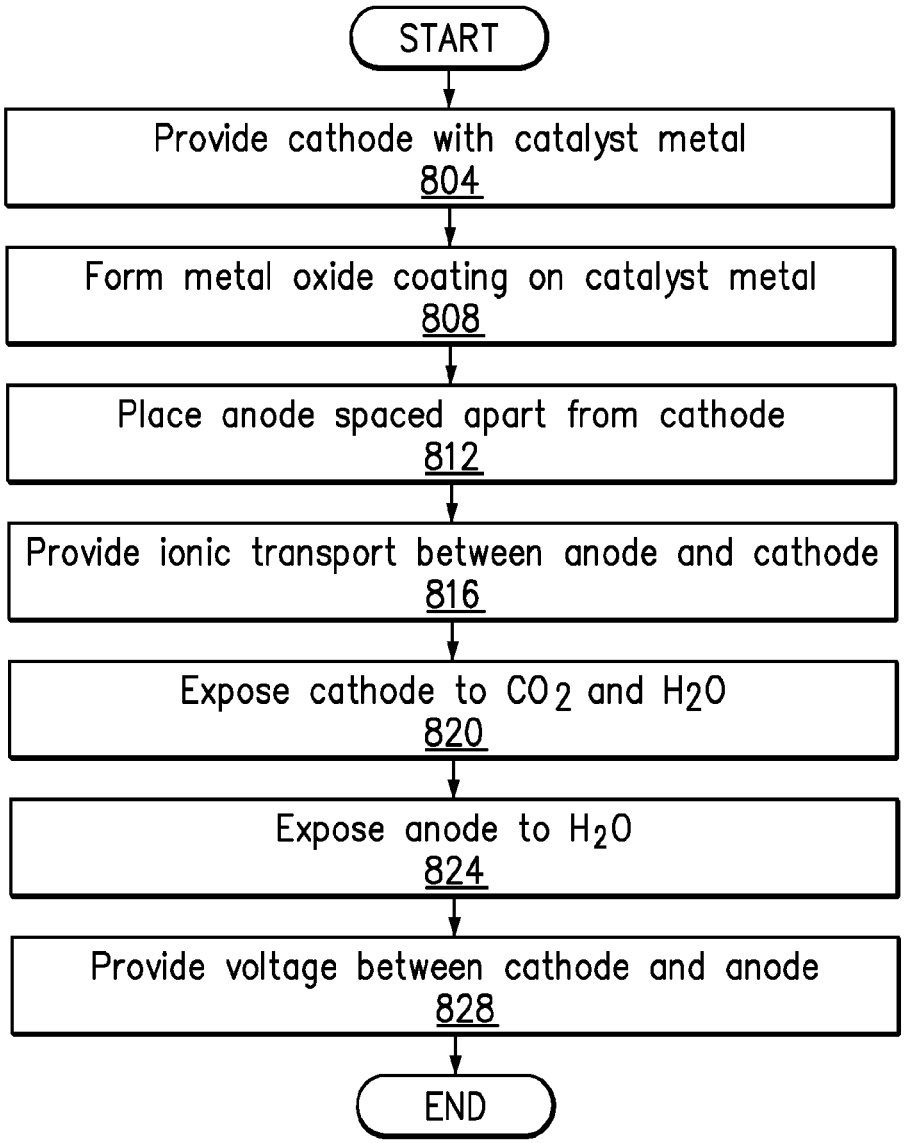
FIG. 8 is a high level flow chart of an embodiment of the invention.

To facilitate understanding of the invention, FIG. 8 is a high level flow chart of an embodiment of the invention. In this embodiment, a cathode with a catalyst metal is provided (step 804). A metal oxide coating is formed on the catalyst metal (step 808). The metal oxide coating and the catalyst metal form a metal and metal oxide coating, which may comprise a metal oxide coating over a metal coating or a single coating with both metal oxide particles and metal particles. An anode is spaced apart from the cathode (step 812). An ionic transport is provided between the anode and cathode (step 816). The cathode is exposed to $CO_2$ and $H_2O$ (step 820). The anode is exposed to $H_2O$ (step 824). A voltage is provided between the cathode and anode (step 828). The voltage causes $CO_2$ and $H_2O$ to be reduced to CO, $H_2$, and $O_2$. The CO and $H_2$ may be converted to hydrocarbon or alcohol products.

Figure 9A:
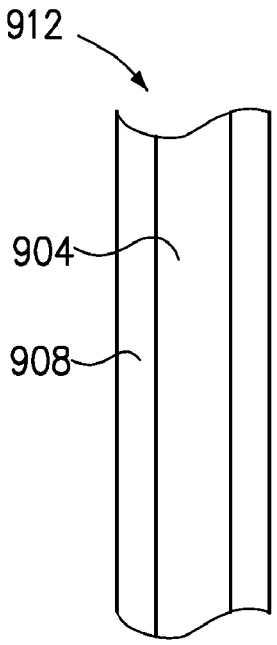
FIGS. 9A-B are enlarged cross-sectional views of part of a conductive substrate with a metal coating, forming part of a cathode.

In a specific embodiment of the invention, the cathode is formed by providing a conductive substrate (step 804) with a catalyst metal coating (step 808). FIG. 9A is an enlarged cross-sectional view of part of a conductive substrate 904 with a metal coating 908, forming part of a cathode 912. In this example, the conductive substrate 904 is steel. The metal coating 908 is copper. The conductive substrate may be in the form of a net over which the metal coating is applied. In other embodiments, the conductive substrate and metal coating may be a single piece of the same material, such as a copper wire. In such a case, the metal coating may be considered an outer layer of the metal substrate.

Figure 9B:
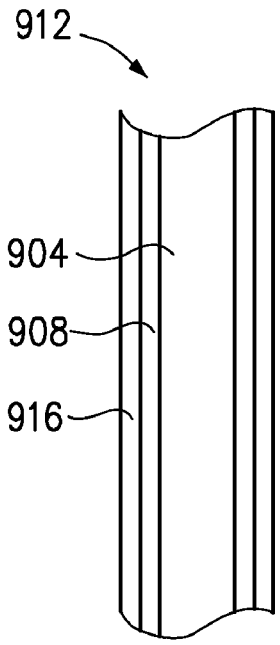

A metal oxide coating is formed on the catalyst metal (step 808). FIG. 9B shows the part of the cathode 912 after the metal oxide coating 916 is formed. In this example, part of the copper catalyst metal coating 908 is formed into copper oxide by heating the cathode to at least 300° C. for at least 15 minutes. Preferably, the metal oxide coating is thicker than a native oxide layer. For example, the metal oxide coating has a thickness of at least twice the thickness of a native metal oxide layer. More preferably, the metal oxide coating is at least 50 nm thick. In other embodiments, the metal oxide coating 916 may be provided by a deposition process to deposit the metal oxide coating on the catalyst metal coating. In this example the copper catalyst metal coating 908 and the metal oxide coating 916 form a metal and metal oxide coating. In other embodiment, metal particles and metal oxide particles may form a single layer to form the metal and metal oxide coating.

In some embodiments, some or all of the native metal oxide layer may be reduced before or during usage as a cathode. In the specification and claims, the term "oxidized cathode" will apply to a cathode on which an oxide layer is formed on the cathode by a process that increases the thickness of the metal oxide beyond that of a native metal oxide, whether the metal oxide coating remains or is subsequently reduced. Therefore the oxidized cathode is a cathode with a oxidized cathode layer, which is a metal and metal oxide coating where the metal oxide either remains or is reduced back to metal, and wherein the metal oxide is at least twice as thick as native metal oxide.

Figure 10:
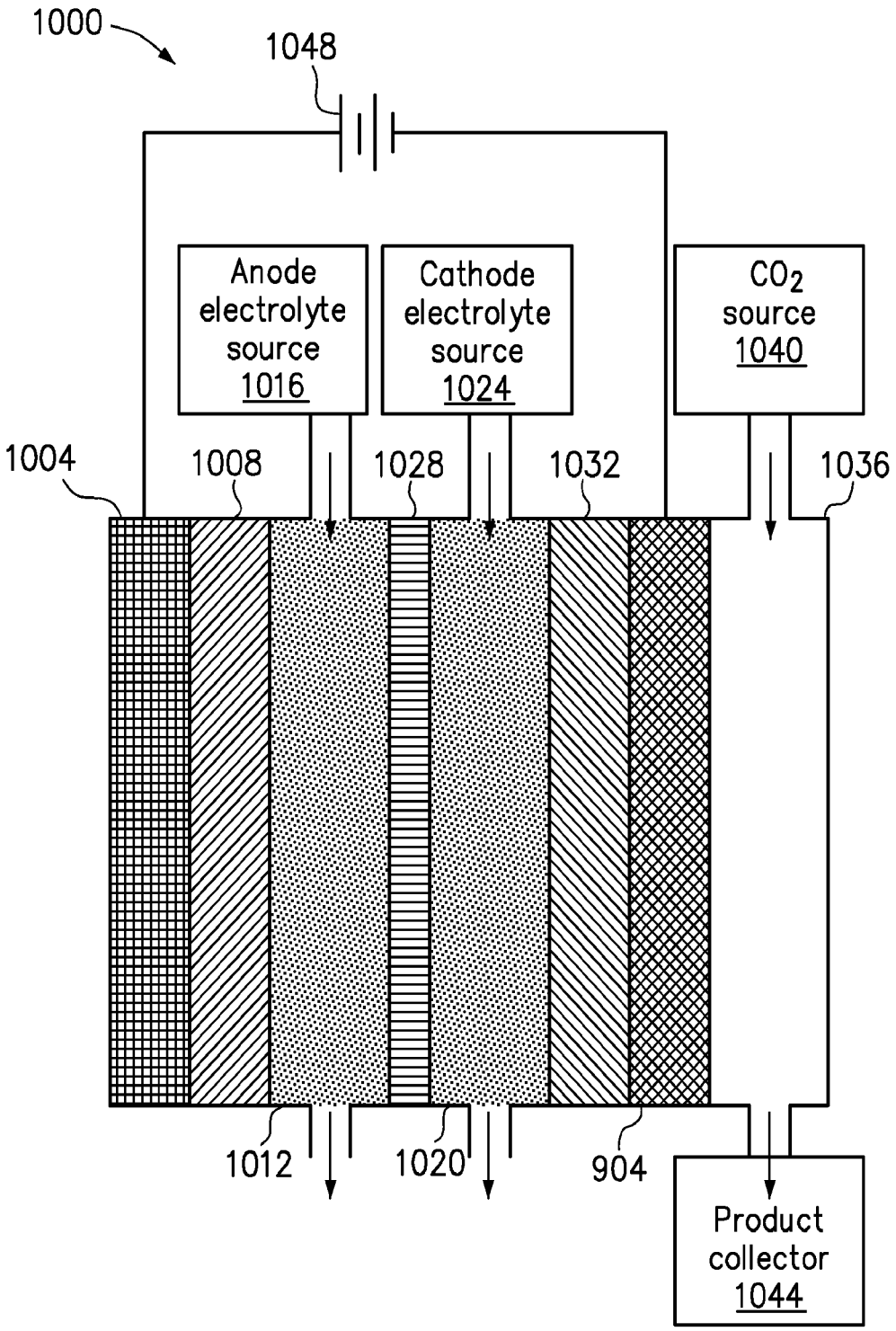
FIG. 10 is a schematic view of an electrolyzer that may be used in an embodiment of the invention.

An anode is spaced apart from the cathode (step 812). FIG. 10 is a schematic view of an electrolyzer 1000 that may be used in an embodiment of the invention. An anode is formed by a conductive anode substrate 1004 covered with an anode material 1008. In this example, the anode material 1008 is nickel. An anode electrolyte compartment 1012 is adjacent to the anode and holds an anode electrolyte. The anode electrolyte is provided from an anode electrolyte source 1016, which may continuously circulate anode electrolyte through the anode electrolyte compartment 1012. A cathode electrolyte compartment 1020 holds a cathode electrolyte. The cathode electrolyte is provided from a cathode electrolyte source 1024, which may continuously circulate cathode electrolyte through the cathode electrolyte compartment 1020. Alternatively, the cathode electrolyte may flow to a tank where the solution-phase products are collected. A separator 1028 is placed between the anode electrolyte compartment 1012 and the cathode electrolyte compartment 1020. The separator

1028 may be a porous frit or membrane that may allow certain ions to pass through the separator 1028. As described above, a cathode comprising a conductive substrate 904 with an oxidized cathode layer 1032 forms a cathode adjacent to the cathode electrolyte compartment 1020. In this embodiment, a gas chamber 1036 is placed on the backside of the cathode. A $CO_2$ source 1040 provides a flow of $CO_2$ into the gas chamber 1036. A product collector 1044 collects gas-phase products and unused $CO_2$ from the gas chamber 1036. Product in the product collector 1044 may be isolated and the remaining $CO_2$ may be recycled back to the $CO_2$ source 1040. A voltage source 1048, such as a battery, provides a voltage between the anode and cathode.

In operation, the anode electrolyte source 1016 flows electrolyte through the anode electrolyte compartment 1012. The cathode electrolyte source 1024 flows electrolyte through the cathode electrolyte compartment 1020. $CO_2$ is flowed from the $CO_2$ source 1040 into the gas chamber 1036. The voltage source 1048 applies a positive voltage to the anode substrate 1004 and a negative voltage to the cathode substrate 904 with the anode connected to a positive terminal and the cathode connected to a negative terminal. The process provides electrolysis of the $CO_2$. Various chemical reactions may occur during the electrolysis of $CO_2$, depending on the metal cathode and other factors. One chemical reaction is $CO_2+H_2O \rightarrow CO+H_2+O_2$. Other chemical reactions provide products of $HCO_2H$, $CH_3OH$ or $C_2H_4$. In a preferred embodiment, the product collector 1044 provides the product to another system that converts CO, $O_2$, and $H_2$ and possibly other products to methanol or some other fuel or usable chemical.

It has been unexpectedly found that by providing a metal oxide layer on a cathode that is thicker than the native oxide layer and subsequently reducing the metal oxide layer, the reduction of $CO_2$ is improved. Without being bound by theory, it is believed that the reduction of the thick metal oxide layer results in metal particles that have unique structures that result in improved $CO_2$ reduction, however, the reason for the improvement is currently unknown. It has also been unexpectedly found that for some cathodes having a metal and metal oxide interface improves $CO_2$ reduction. Preferably, the metal and metal oxide use the same metal material. However, in an embodiment using cerium oxide, the metal is something other than cerium such as tin or copper. Since cerium would turn to cerium oxide during electrolysis, tin is used to provide a native metal for an enhanced metal oxide metal interface, which provides improved $CO_2$ reduction.

As demonstrated above, copper cathodes that are annealed at 130° C. to grow the oxidation layer do not provide the desired improvement. Annealing copper at 300° C. provides some improvement. It has been found that annealing copper at over 500° C. provides the preferred improvement. Anodization at a constant potential for several hours can also be used to obtain a thick $Cu_2O$ layer on Cu and results in improved $CO_2$ reduction.

In the case of some metals such as gold, neither annealing in air or $O_2$ or anodization at a constant potential is effective for preparing a thick oxide layer. Instead, a square wave potential routine is preferred to obtain the metal oxide layer. In the case of gold, a thick, hydrous $Au_2O_3$ layer can be formed on the Au electrode by applying a square wave potential alternating between 2.7 V and 0.45 V vs $Hg/HgSO_4$ at a frequency of 1 kHz for 30-60 min. Subsequent reduction of this $Au_2O_3$ layer results in a Au electrode with greatly improved $CO_2$ reduction activity and resistance to catalyst deactivation. Similarly, growth of a silver oxide on silver electrodes by application of a square wave potential routine, followed by electrochemical reduction, results in a Ag electrode with greatly improved $CO_2$ reduction activity and resistance to catalyst deactivation.

While this invention has been described in terms of several preferred embodiments, there are alterations, permutations, modifications and various substitute equivalents, which fall within the scope of this invention. It should also be noted that there are many alternative ways of implementing the methods and apparatuses of the present invention. It is therefore intended that the following appended claims be interpreted as including all such alterations, permutations, modifications, and various substitute equivalents as fall within the true spirit and scope of the present invention.

What is claimed is:

1. A method for electrochemically reducing $CO_2$ comprising:

providing a cathode, wherein the cathode comprises a conductive substrate with a catalyst of a metal and a metal oxide based coating on a side of the cathode, wherein the providing the cathode comprises:

providing a conductive substrate with a metal coating;

providing on the conductive substrate a metal oxide coating by either annealing the metal coating, electrochemically oxidizing the metal coating, chemically oxidizing the metal coating, or depositing a metal oxide layer; and reducing metal oxide in the metal and metal oxide based coating to the metal 0 oxidation state;

providing an anode spaced apart from the cathode;

providing an ionic transport between the anode and cathode;

exposing the cathode to CO2 and H2O exposing the anode to H2O;

providing a voltage between the cathode and anode; and reducing $CO_2$ to CO and/or $HCO_2H$.

2. The method, as recited in claim 1, wherein the metal oxide is tin oxide, copper oxide, silver oxide, palladium oxide, gold oxide, molybdenum oxide, lead oxide, platinum oxide, nickel oxide, bismuth oxide, antimony oxide or cerium oxide.

3. The method, as recited in claim 2, wherein the metal oxide is thicker than a native oxide.

4. The method, as recited in claim 3, where the metal oxide in the metal and metal oxide based coating has a thickness that is greater than 50 nm.

5. The method, as recited in claim 1, where the metal oxide in the metal and metal oxide based coating has a thickness that is greater than twice a thickness of a native oxide layer.

6. The method, as recited in claim 1, wherein the metal oxide and metal are of the same metal material.

7. The method, as recited in claim 1, wherein the metal and metal oxide containing coating provide a metal and metal oxide interface.

8. The method, as recited in claim 1, wherein the exposing the cathode to $CO_2$ and $H_2O$, comprises:

exposing a first side of the cathode to $H_2O$; and flowing $CO_2$ past a second side of the cathode.

9. The method, as recited in claim 1, wherein the providing the cathode, comprises:

applying an anodic square wave potential to the metal coating to form an oxide layer.

10. The method, as recited in claim 9, wherein the metal coating is gold or silver.

11. The method, as recited in claim 1, wherein the cathode is copper and the coating is formed by heating the cathode to a temperature of at least 500° C. for at least 15 minutes.

12. The method, as recited in claim 1, wherein the cathode is copper and the coating is formed by heating the cathode to a temperature of at least 300° C. for at least 15 minutes.

13. The method, as recited in claim 1, wherein the reducing $CO_2$ to CO and/or $HCO_2H$ reduces $CO_2$ to $HCO_2H$.

* * * * *